US010823540B2

(12) United States Patent
Marin et al.

(10) Patent No.: US 10,823,540 B2
(45) Date of Patent: Nov. 3, 2020

(54) PROJECTILES FOR AMMUNITION AND METHODS OF MAKING AND USING THE SAME

(71) Applicant: Quantum Ammunition, LLC, Savannah, GA (US)

(72) Inventors: Juan Carlos Marin, Girona (ES); Paul Lemke, Savannah, GA (US)

(73) Assignee: Quantum Ammunition, LLC, Savannah, GA (US)

( * ) Notice: Subject to any disclaimer, the term of this patent is extended or adjusted under 35 U.S.C. 154(b) by 6 days.

(21) Appl. No.: 16/218,542

(22) Filed: Dec. 13, 2018

(65) Prior Publication Data

US 2019/0186879 A1 Jun. 20, 2019

Related U.S. Application Data

(60) Provisional application No. 62/598,919, filed on Dec. 14, 2017.

(51) Int. Cl.
*F42B 12/34* (2006.01)
*F42B 5/02* (2006.01)
*F42B 10/24* (2006.01)

(52) U.S. Cl.
CPC ..... *F42B 12/34* (2013.01); *F42B 5/025* (2013.01); *F42B 10/24* (2013.01)

(58) Field of Classification Search
CPC .. F42B 5/02; F42B 5/025; F42B 10/24; F42B 12/34
USPC ..... 102/439
See application file for complete search history.

(56) References Cited

U.S. PATENT DOCUMENTS 463,922 A * 11/1891 Russell ..... F42B 10/24 244/3.23
760,338 A * 5/1904 Kwiatkowski ..... F42B 10/30 244/3.23
2,612,108 A * 9/1952 Schmidt ..... F42B 12/06 102/519
4,136,616 A * 1/1979 Schirneker ..... F42B 12/34 102/510
4,251,079 A 2/1981 Earl
4,301,733 A * 11/1981 Arciniega Blanco ... F42B 10/24 102/517
4,644,866 A * 2/1987 Sullivan ..... F42B 7/10 102/439
5,133,261 A 7/1992 Kelsey
5,259,319 A * 11/1993 Dravecky ..... F42B 5/073 102/439

(Continued)

FOREIGN PATENT DOCUMENTS

DE 16742 11/1882
WO 2015/048102 4/2015
WO 2016/007212 1/2016

OTHER PUBLICATIONS

PCT/US2018/065436, International Search Report dated Feb. 26, 2019.

*Primary Examiner* — Stephen Johnson
*Assistant Examiner* — Benjamin S Gomberg
(74) *Attorney, Agent, or Firm* — Withers & Keys, LLC

(57) ABSTRACT

Projectiles for ammunition and ammunition for firearms are disclosed. Methods of making projectiles for ammunition and ammunition for firearms, and methods of using projectiles for ammunition and ammunition for firearms are also disclosed.

17 Claims, 12 Drawing Sheets

(56) References Cited

U.S. PATENT DOCUMENTS

| | | | | |
|---|---|---|---|---|
| 5,841,058 | A * | 11/1998 | Manis | F41A 1/02 89/8 |
| 5,932,836 | A * | 8/1999 | White | F42B 10/22 102/529 |
| 6,439,125 | B1 * | 8/2002 | Carter | F42B 5/025 102/507 |
| 6,679,178 | B2 * | 1/2004 | Mihaylov | F42B 10/24 102/439 |
| 6,692,083 | B2 | 2/2004 | Latham | |
| 7,484,459 | B2 * | 2/2009 | Fichot | F42B 10/22 102/501 |
| 7,526,998 | B2 | 5/2009 | Vasel | |
| 8,192,310 | B2 * | 6/2012 | Harris | F42B 6/08 473/582 |
| 8,789,470 | B2 * | 7/2014 | Frank | F42B 7/10 102/506 |
| D732,635 | S | 6/2015 | Riley | |
| D733,834 | S | 7/2015 | Burczynski | |
| D735,289 | S | 7/2015 | Burczynski | |
| D748,220 | S | 1/2016 | Fricke | |
| D752,702 | S | 3/2016 | Vera | |
| D752,703 | S | 3/2016 | Vera | |
| D753,258 | S | 4/2016 | Vera | |
| 9,354,027 | B2 | 5/2016 | Flint | |
| D759,781 | S | 6/2016 | Hagan | |
| D764,624 | S | 8/2016 | Masinelli | |
| D765,215 | S | 8/2016 | Gibson | |
| D775,305 | S | 12/2016 | Fiocchi | |
| D780,282 | S | 2/2017 | Riley | |
| D781,993 | S | 3/2017 | Schultz | |
| D782,601 | S | 3/2017 | Riley | |
| D782,602 | S | 3/2017 | Riley | |
| 9,709,368 | B2 | 7/2017 | Mahnke | |
| 9,829,293 | B2 * | 11/2017 | Fricke | F42B 12/04 |
| 9,841,260 | B2 | 12/2017 | Lemke et al. | |
| D813,974 | S | 3/2018 | Peterson | |
| 10,036,619 | B2 * | 7/2018 | Fricke | F42B 12/04 |
| 10,119,797 | B2 * | 11/2018 | Burczynski | F42B 10/38 |
| 10,690,463 | B2 * | 6/2020 | Carbone | F42B 10/46 |
| 2002/0100389 | A1 | 8/2002 | May | |
| 2006/0027128 | A1 | 2/2006 | Hober | |
| 2007/0074637 | A1 | 4/2007 | Pontieri | |
| 2007/0151474 | A1 * | 7/2007 | Widener | F42B 10/24 102/501 |
| 2008/0127850 | A1 * | 6/2008 | Radchenko | F42B 5/02 102/439 |
| 2016/0047638 | A1 | 2/2016 | Golioher | |
| 2016/0231093 | A1 * | 8/2016 | Lemke | F42B 12/74 |
| 2017/0052008 | A1 * | 2/2017 | Peterson | F42B 33/00 |
| 2017/0131071 | A1 * | 5/2017 | Burkart | F42B 10/44 |
| 2017/0322002 | A1 * | 11/2017 | Mahnke | F42B 12/06 |
| 2019/0113320 | A1 * | 4/2019 | Folaron | F42B 12/34 |
| 2019/0249964 | A1 * | 8/2019 | Stock, Jr. | F42B 12/34 |

* cited by examiner

PROJECTILES FOR AMMUNITION AND METHODS OF MAKING AND USING THE SAME

CROSS-REFERENCE TO RELATED APPLICATIONS

This patent application claims the benefit of priority to U.S. Provisional Patent Application Ser. No. 62/598,919 filed on Dec. 14, 2017 and entitled "PROJECTILES FOR AMMUNITION AND METHODS OF MAKING AND USING THE SAME," the subject matter of which is hereby incorporated by reference in its entirety.

FIELD OF THE INVENTION

The present invention relates to projectiles for ammunition, and ammunition for firearms. The present invention also relates to methods of making projectiles for ammunition and methods of using projectiles for ammunition.

BACKGROUND OF THE INVENTION

Metal and non-metal (i.e., polymeric) projectiles are known. For example, U.S. Pat. No. 5,237,930 (Belanger et al.) discloses projectiles comprising a thermoplastic material (i.e., polyamide) matrix filled with copper powder. The resulting "frangible projectiles" possess (1) similar ballistic effects as conventional projectiles, and (2) the ability to disintegrate upon impact with a hard surface.

Using a similar powder metallurgy concept, U.S. Pat. No. 6,074,454 (Abrams et al.) and U.S. Pat. No. 6,090,178 (Benini) proposed to make a similar projectile, but used only metal powder without any kind of polymeric binder, sintered by itself.

U.S. Pat. No. 6,149,705 (Lowden et al.) and U.S. Pat. No. 6,263,798 (Benini) disclosed applying a powder metallurgical manufacturing concept projectile again, by joining metal powder together via another metal, as a binder, with lower melting temperature, in an attempt to emulate the original work of Belanger et al. without sintering and without non-metallic material processing.

U.S. Pat. No. 6,546,875 (Vaughn et al.) disclosed a design and manufacturing method of a hollow-point projectile without using lead. The disclosed design included a hollow tip made of monolithic tin in combination with a powder metallurgic component around the monolithic tin to give weight to the projectile with all comprised in a coating of copper or brass.

The present inventors developed projectiles for ammunition as disclosed in U.S. Pat. No. 9,841,260, the subject matter of which is hereby incorporated by reference in its entirety. The disclosed projectiles provide exceptional performance due to the specific design of the impact end of the projectile, and other disclosed features. The development of the disclosed projectiles took into account: (1) the material(s) used to form the projectile, knowing that, in some cases (e.g., a polymer filled with metal particles), the material(s) would be relatively light and the resulting projectile would travel at a higher velocity and spin much faster than conventional bullets; (2) velocity and revolutions per minute (or second) of the resulting projectile; (3) the ability of the projectile shape to disrupt soft tissue even when using lower than normal bullet mass; (4) the need for the bullet to be able to be fed reliably into a wide variety of firearms on the market (e.g., pistols, air guns, rifles, machine guns, etc.); (5) the target accuracy of the resulting projectile upon firing from a weapon, and the development of correct projectile diameters and base configurations to deliver peak accuracy; and (6) barrel wear on the firearm due to the projectile design/materials.

In view of prior projectile developments, the present inventors have continued their efforts to develop projectiles with the goal of developing new projectiles (e.g., metal and/or non-metal) that possess many of the above traits of projectiles disclosed in U.S. Pat. No. 9,841,260, as well as additional traits that improve the performance of projectiles for ammunition.

SUMMARY OF THE INVENTION

The present invention continues the development of new projectiles and ammunition containing projectiles. The projectiles (e.g., metal and/or non-metal) of the present invention enable the production of ammunition that provides one or more of the following benefits: (1) a tough, durable bullet that easily penetrates soft tissue, but may remain frangible (or non-frangible) on steel targets; (2) utilizes the different forms of projectile energy, i.e., kinetic and rotational, upon exiting a firearm barrel so as to transfer an optimum amount of energy to soft tissue; (3) maintains a shape that results in essentially 100% reliability with regard to feeding into a firearm; (4) results in a minimum amount of fouling even at high velocities; (5) results in a minimum amount of undue wear to the throat or barrel of firearms; (6) displays exceptional accuracy upon firing; and, in some case, (7) is about 30% lighter than conventional bullets, which translates into lower shipping costs, higher velocities and less recoil.

Accordingly, in one exemplary embodiment, the present invention is directed to projectiles for ammunition. In some exemplary embodiments, the projectile for ammunition comprises an outer profile geometry on an ogive-shaped impact end portion thereof, said outer profile geometry comprising two or more channels extending along a portion of an outer periphery of said ogive-shaped impact end portion that is positioned within a plane P1 that contains a maximum diameter $D_{max}$ of said ogive-shaped impact end portion.

In some exemplary embodiments, the projectile for ammunition comprises an outer profile geometry on an ogive-shaped impact end portion thereof, the outer profile geometry comprising two or more channels extending along a portion of an outer periphery of the ogive-shaped impact end portion that is positioned within a plane P1 that contains a maximum diameter $D_{max}$ of the ogive-shaped impact end portion, and wherein each of the two or more channels (i) extends a length $L_c$ that is parallel relative to a dissecting axis extending longitudinally through the impact end portion of the projectile, and (ii) comprises a channel surface, at least a portion of the channel surface being parallel relative to the dissecting axis. In some exemplary embodiments, a majority (>50% of the total channel surface area) of or all (100% of the channel surface area) of the channel surface of each channel is parallel relative to the dissecting axis.

In some exemplary embodiments, the projectile for ammunition comprises an outer profile geometry on an ogive-shaped impact end portion thereof, the outer profile geometry comprising two or more channels extending along a portion of an outer periphery of the ogive-shaped impact end portion that is positioned within a plane P1 that contains a maximum diameter $D_{max}$ of the ogive-shaped impact end portion, and wherein each of the two or more channels (i) extends a length $L_c$ that is parallel relative to a dissecting axis extending longitudinally through the impact end portion of the projectile, and (ii) comprises channel surface portions that form a circular cross-sectional configuration within a given channel (i.e., (i) within a plane normal to a given channel and (ii) bound by opposite lateral side edge of the channel).

In some exemplary embodiments, the projectile for ammunition comprises (i) an ogive-shaped impact end portion, (ii) a step portion positioned between said ogive-shaped impact end portion and an opposite end of said projectile, and (iii) an outer profile geometry on said ogive-shaped impact end portion and said step portion, said outer profile geometry comprising two or more channels extending (a) along a portion of an outer periphery of said ogive-shaped impact end portion that is positioned within a plane P1 that contains a maximum diameter $D_{max}$ of said ogive-shaped impact end portion and (b) into said step portion.

In some exemplary embodiments, the projectile for ammunition comprises (i) an ogive-shaped impact end portion having a maximum diameter $D_{max}$, (ii) a shank portion opposite said ogive-shaped impact end portion, said shank portion having a shank portion diameter $D_{shank}$ that is less than said maximum diameter $D_{max}$, and (iii) two or more ribs extending outward from and being equally spaced from one another along a shank portion outer surface of said shank portion.

Any of the herein-described projectiles may have an outer profile geometry that further comprises two or more notches extending axially along said outer surface profile, wherein each notch: (a) comprises notch surface portions so as to increase (i) an overall outer surface area of said ogive end portion of projectile, and (ii) a given length of an outer surface periphery $S_p$ extending along a line within a plane normal to said dissecting axis, (b) is at least partially surrounded by an outer surface of said ogive-shaped impact end portion of said projectile; (c) comprises a notch depth dissecting line $L_{dd}$ extending axially through and being located along a path that represents a largest depth within said notch, (d) comprises notch outer periphery points $P_L$,$P_R$ along an outer notch perimeter on opposite sides of said notch depth dissecting line $L_{dd}$, and (e) comprises right and left-hand line portions $\mathbf{25}_L$,$\mathbf{25}_R$ of a normal line extending from said notch depth dissecting line $L_{dd}$ to each notch outer periphery point $P_L$,$P_R$, wherein each of said right and left-hand line portions $\mathbf{25}_L$,$\mathbf{25}_R$ (i) increases in length along at least a first portion of said notch depth dissecting line $L_{dd}$ and subsequently (ii) decreases in length along at least a second portion of said notch depth dissecting line $L_{dd}$ extending between an uppermost periphery portion of said notch and a lowermost periphery portion of said notch. In desired embodiments, the herein-described projectiles of the present invention comprise two or more notches, wherein each notch intersects with a corresponding channel along said ogive-shaped impact end portion as described herein.

The present invention is even further directed to methods of making projectiles for ammunition. In some exemplary embodiments, the method of making a projectile for ammunition comprises at least one of: (i) injection molding a plastic material filled with or without metal particles, (ii) sintering and/or (iii) machining so as to from any of the herein-described metal or polymeric projectiles.

In some exemplary embodiments, the method of making a projectile for ammunition comprises forming any one of the herein-described projectiles, said forming step selected from any one or any combination of: (i) a molding step, (ii) a stamping step, (iii) a machining step, (iv) a pressure-applying step, and (v) a striking step.

In some exemplary embodiments, the method of making a projectile for ammunition comprises forming a projectile, wherein the projectile comprises an outer profile geometry on an ogive-shaped impact end portion thereof, said outer profile geometry comprising two or more channels extending along a portion of an outer periphery of said ogive-shaped impact end portion that is positioned within a plane P1 that contains a maximum diameter $D_{max}$ of said ogive-shaped impact end portion.

In some exemplary embodiments, the method of making a projectile for ammunition comprises forming a projectile, wherein the projectile comprises (i) an ogive-shaped impact end portion, (ii) a step portion positioned between said ogive-shaped impact end portion and an opposite end of said projectile, and (iii) an outer profile geometry on said ogive-shaped impact end portion and said step portion, said outer profile geometry comprising two or more channels extending (a) along a portion of an outer periphery of said ogive-shaped impact end portion that is positioned within a plane P1 that contains a maximum diameter $D_{max}$ of said ogive-shaped impact end portion and (b) into said step portion.

In some exemplary embodiments, the method of making a projectile for ammunition comprises forming a projectile, wherein the projectile comprises (i) an ogive-shaped impact end portion having a maximum diameter $D_{max}$, (ii) a shank portion opposite said ogive-shaped impact end portion, said shank portion having a shank portion diameter $D_{shank}$ that is less than said maximum diameter $D_{max}$, and (iii) two or more ribs extending outward from and being equally spaced from one another along a shank portion outer surface of said shank portion.

The present invention is even further directed to a method of using projectiles for ammunition. In one exemplary embodiment, the method of using a projectile for ammunition comprises: positioning a composite or polymer or metal casing comprising any one of the herein-described projectiles in a chamber of a projectile-firing weapon; and firing the weapon. In some embodiments, the projectile-firing weapon comprises a pistol or any other type of hand gun. In other embodiments, the projectile-firing weapon comprises a rifle, and air-rifle, or any other type of long gun. In other embodiments, the projectile-firing weapon comprises a machine gun or submachine gun.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to projectiles for ammunition, and ammunition for firearms. The present invention is further directed to methods of making projectiles for ammunition, and ammunition for firearms. The present invention is even further directed to methods of using projectiles for ammunition, and ammunition for firearms.

The projectiles and ammunition of the present invention and methods of making and using projectiles and ammunition of the present invention are further described in the embodiments below.

Projectile and Ammunition Embodiments

Figure 4:
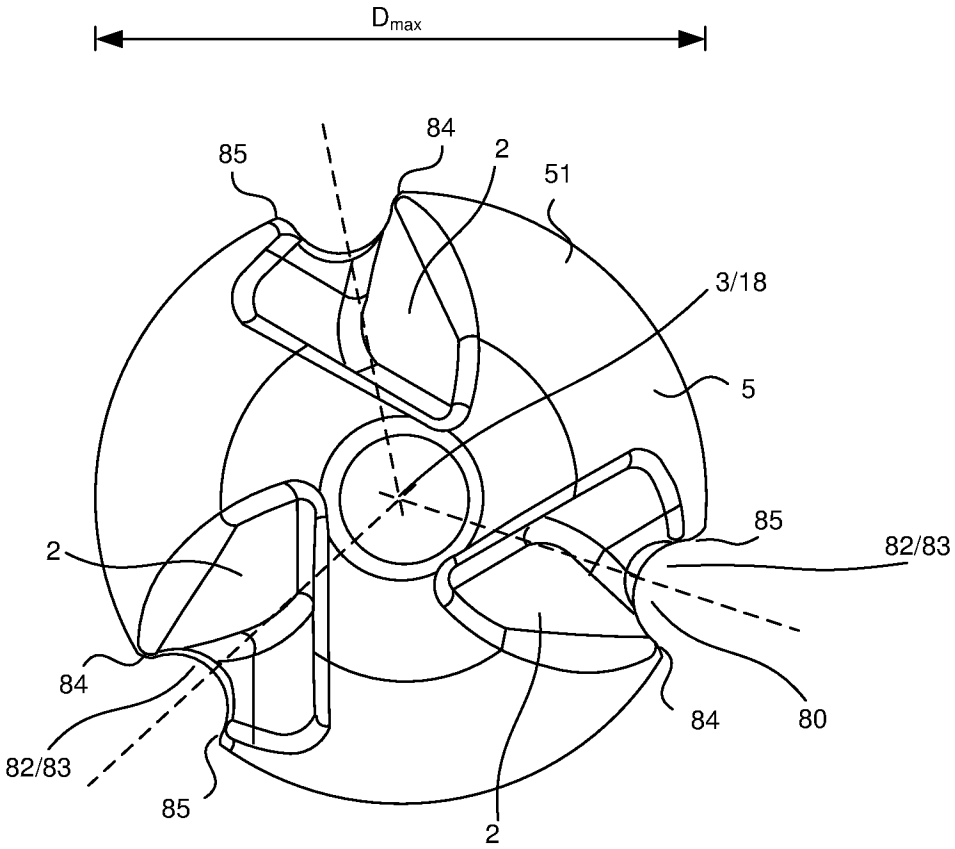
FIG. 4 depicts a top view of the exemplary projectile shown in FIG. 1.
Figure 3:
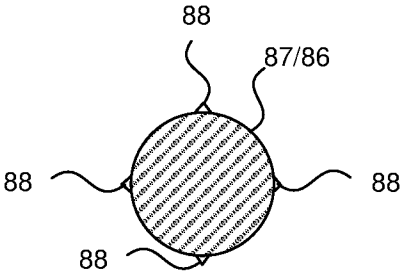
FIG. 3 depicts a cross-sectional view of an exemplary shaft portion of the exemplary projectile shown in FIG. 2 as viewed along line 3-3.
Figure 5:
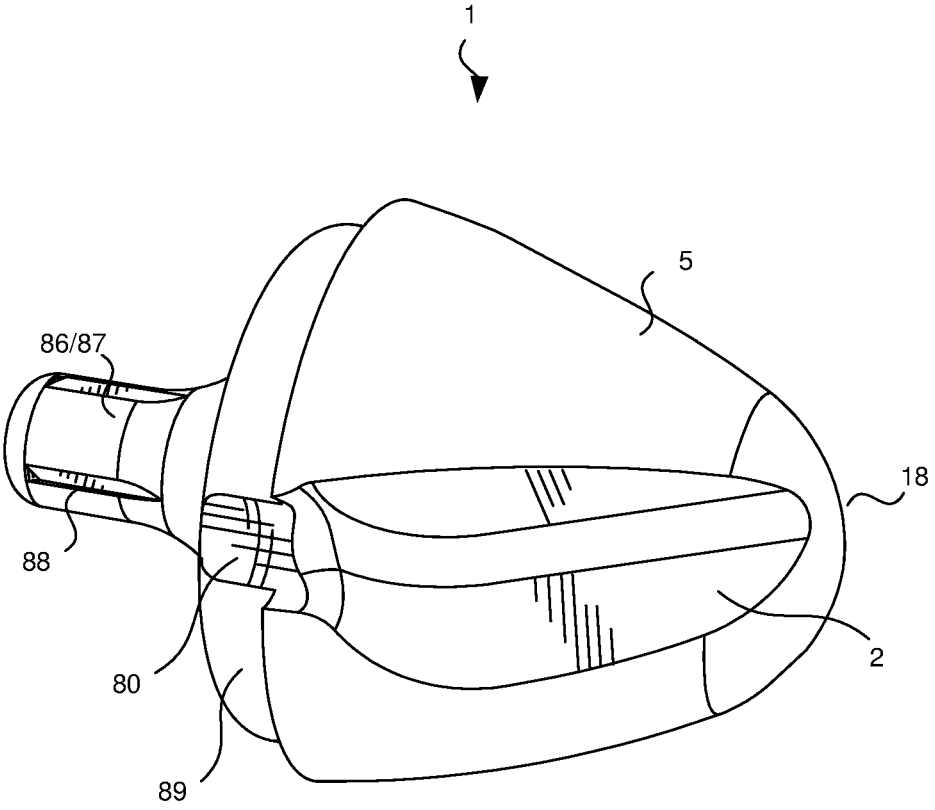
FIG. 5 depicts a perspective view of another exemplary projectile for ammunition of the present invention.
Figure 6:
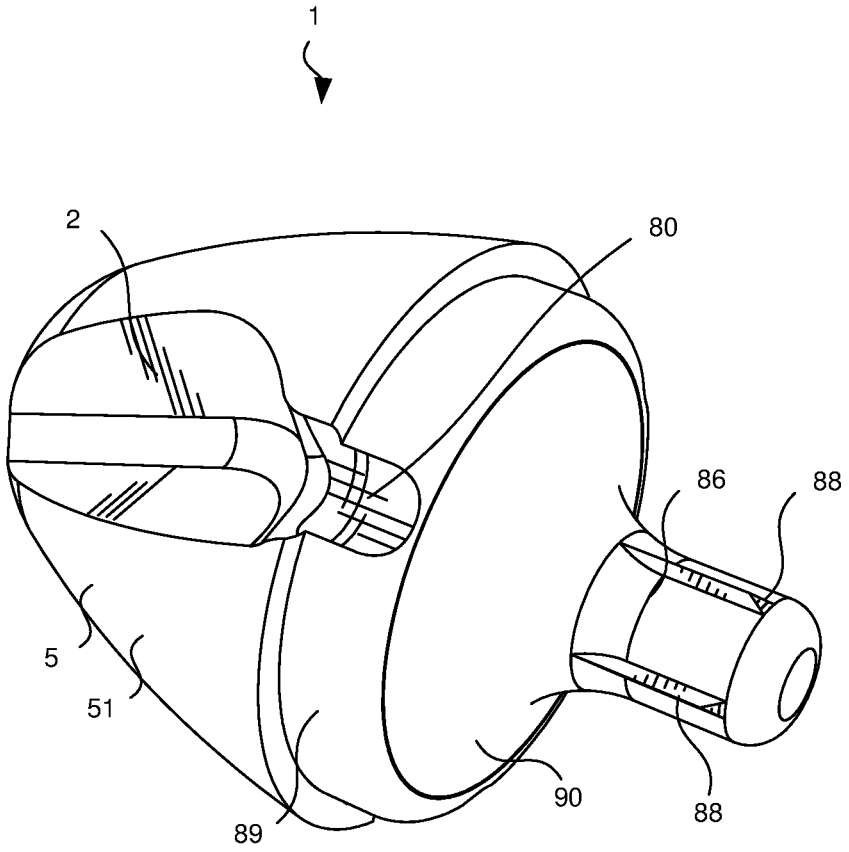
FIG. 6 depicts a perspective side/bottom view of the exemplary projectile shown in FIG. 5.
Figure 7:
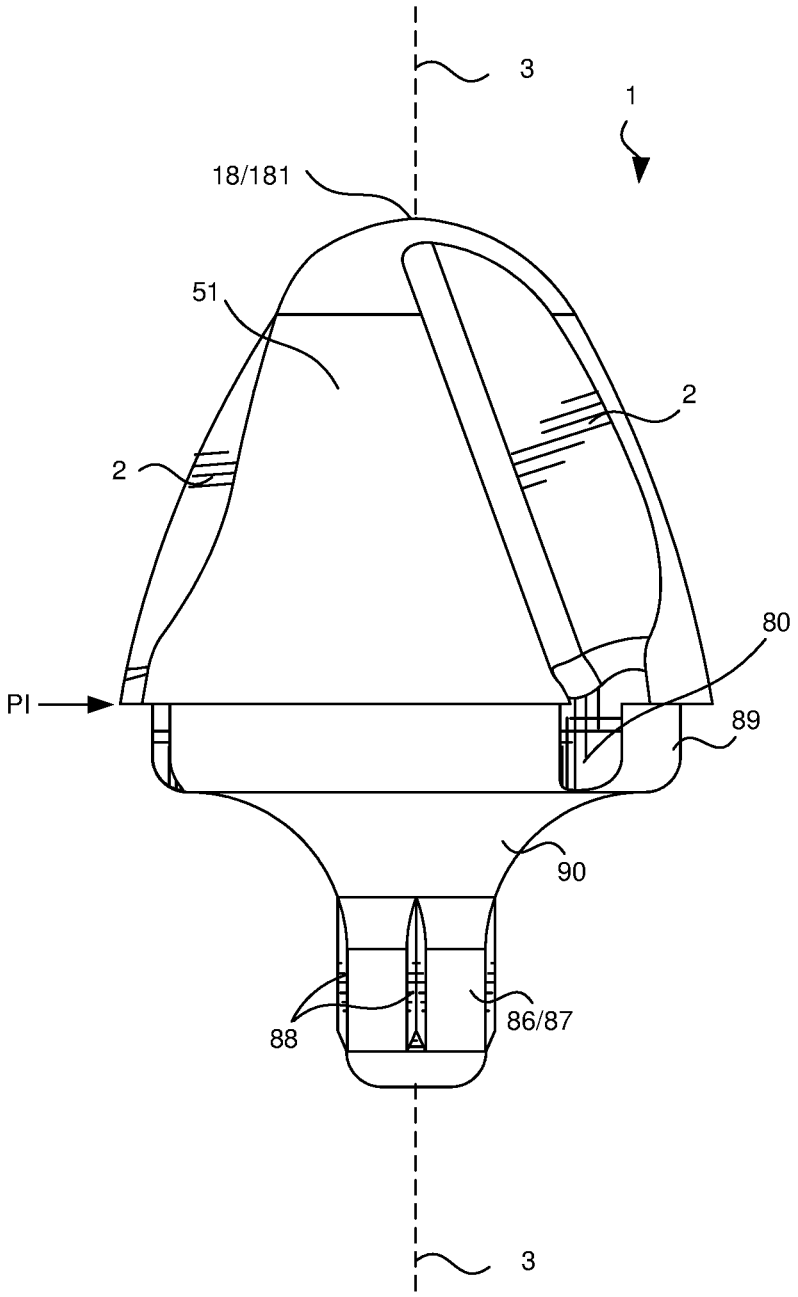
FIG. 7 is a frontal view of the projectile for ammunition shown in FIGS. 5-6.
Figure 8:
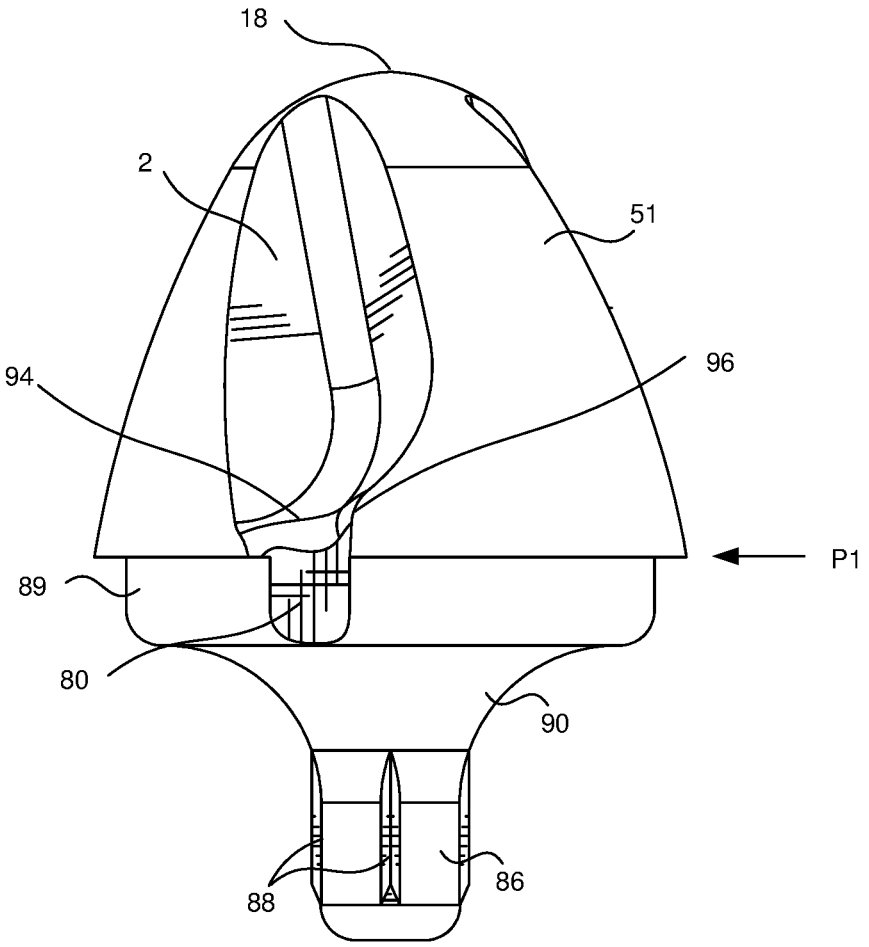
FIG. 8 is a rear view of the projectile for ammunition shown in FIG. 7.
Figure 9:
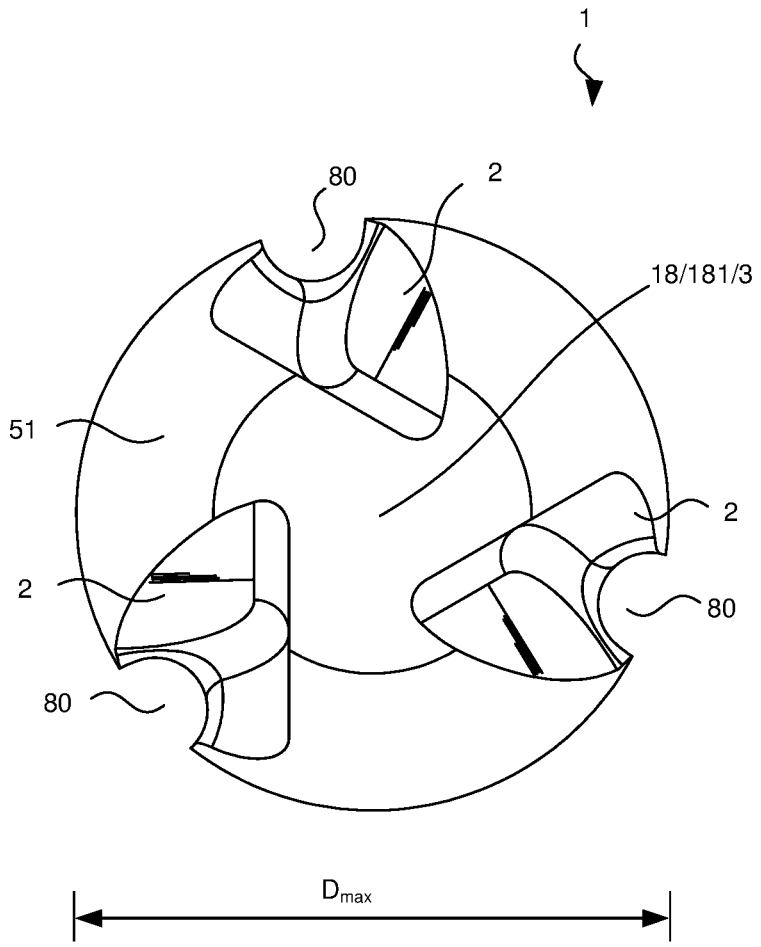
FIG. 9 is a top view of the projectile for ammunition shown in FIG. 7.
Figure 10:
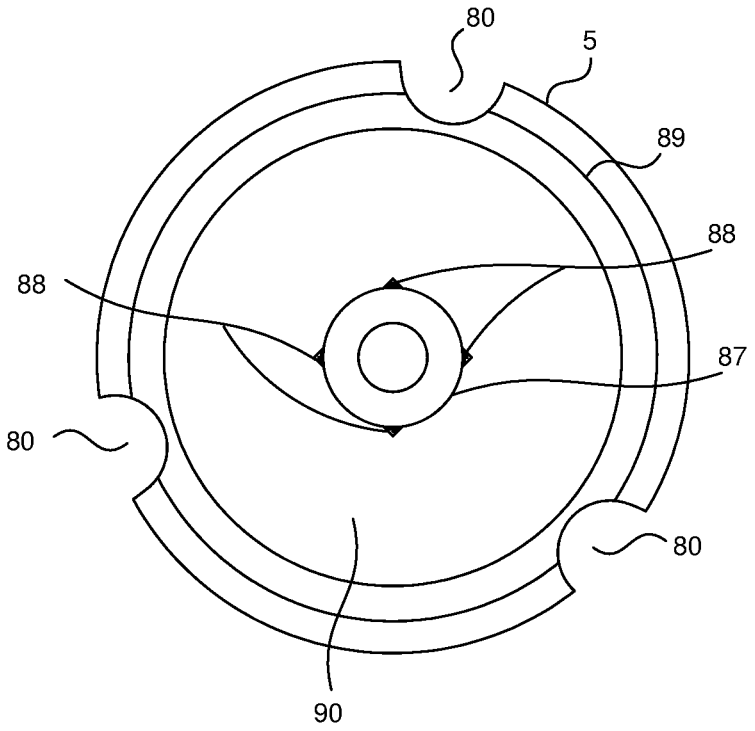
FIG. 10 is a bottom view of the projectile for ammunition shown in FIG. 7.

1. A projectile 1 for ammunition, said projectile 1 comprising an outer profile geometry on an ogive-shaped impact end portion 5 thereof, said outer profile geometry comprising two or more channels 80 extending along a portion of an outer periphery 81 of said ogive-shaped impact end portion 5 that is positioned within a plane P1 that contains a maximum diameter $D_{max}$ of said ogive-shaped impact end portion 5. See, for example, FIG. 2, which shows the plane P1 that contains maximum diameter $D_{max}$ of ogive-shaped impact end portion 5. It should be noted that this plane P1 is normal (i.e., at a 90° angle) to dissecting axis 3 extending longitudinally through said impact end portion 5 of said projectile 1. Each channel 80 within the two or more channels 80 may extend in at least one of (i) an axial, (ii) parallel or (iii) slightly inclined orientation relative to a dissecting axis 3 extending longitudinally through said impact end portion 5 of said projectile 1 as discussed herein. Typically, each channel 80 within the two or more channels 80 extends parallel to dissecting axis 3 extending longitudinally through said impact end portion 5 of said projectile 1.
2. The projectile 1 of embodiment 1, wherein said two or more channels 80 comprise three or more channels 80.
3. The projectile 1 of embodiment 1 or 2, wherein said two or more channels 80 comprise up to eight channels 80 (or any number of channels 80 between 2 and 8).
4. The projectile 1 of any one of embodiments 1 to 3, wherein said two or more channels 80 comprise three channels 80 equally spaced from one another.
5. The projectile 1 of any one of embodiments 1 to 3, wherein said two or more channels 80 comprise four channels 80 equally spaced from one another.
6. The projectile 1 of any one of embodiments 1 to 5, wherein each of said two or more channels 80 extends parallel relative to a dissecting axis 3 extending longitudinally through said impact end portion 5 of said projectile 1. See, for example, dissecting axis 3 shown in FIG. 2.
7. The projectile 1 of any one of embodiments 1 to 6, wherein each of said two or more channels 80 extends a length $L_c$ that is parallel relative to a dissecting axis 3 extending longitudinally through said impact end portion 5 of said projectile 1. See, for example, length $L_c$ shown in FIG. 2.
8. The projectile 1 of any one of embodiments 1 to 7, wherein each of said two or more channels 80 comprises a channel surface 82, said channel surface 82 comprising one or more channel surface portions 83 extending along a length $L_c$ of said channel 80.
9. The projectile 1 of embodiment 8, wherein said one or more channel surface portions 83 form a geometrically shaped cross-sectional configuration within said channel 80, said geometrically shaped cross-sectional configuration comprising one or more connected channel surface portions 83 extending from one lateral side edge 84 of said channel 80 to an opposite lateral side edge 85 of said channel 80. See, for example, opposite lateral side edges 84/85 shown in FIG. 4. As used herein, the phrase "geometrically shaped cross-sectional configuration" refers to a shape (i) within a plane normal to channel 80 and (ii) bound by one or more connected channel surface portions 83 extending from lateral side edge 84 to opposite lateral side edge 85 of channel 80.
10. The projectile 1 of embodiment 8 or 9, wherein said one or more channel surface portions 83 form a circular cross-sectional configuration within said channel 80 (i.e., has a cylindrically-shaped extending along a length $L_c$ of channel surface 82), said circular cross-sectional configuration comprising one channel surface portion 83 extending from one lateral side edge 84 of said channel 80 to an opposite lateral side edge 85 of said channel 80. See, for example, the circular cross-sectional configuration within channels 80 shown in FIG. 4.
11. The projectile 1 of embodiment 8 or 9, wherein said one or more channel surface portions 83 form a multi-sided cross-sectional configuration within said channel 80, said multi-sided cross-sectional configuration comprising two or more channel surface portions 83 extending from one lateral side edge 84 of said channel 80 to an opposite lateral side edge 85 of said channel 80. Although not shown in the figures, any of the circular cross-sectional configurations within channels 80 shown in FIG. 4 could be replaced with a multi-sided cross-sectional configuration.
12. The projectile 1 of embodiment 11, wherein said multi-sided cross-sectional configuration comprises two channel surface portions 83 extending from one lateral side edge 84 of said channel 80 to an opposite lateral side edge 85 of said channel 80 so as to have a triangular shape, or three channel surface portions 83 extending from one lateral side edge 84 of said channel 80 to an opposite lateral side edge 85 of said channel 80 so as to have a rectangular shape or a square shape or a rhombus shape or a parallelogram shape, or four channel surface portions 83 extending from one lateral side edge 84 of said channel 80 to an opposite lateral side edge 85 of said channel 80 so as to have a pentagon shape or other four-sided shape. It should be understood that a given channel 80 may have any cross-sectional shape with any number of channel surface portions 83 extending from one lateral side edge 84 of said channel 80 to an opposite lateral side edge 85 of said channel 80.

13. The projectile 1 of any one of embodiments 8 to 12, wherein at least a portion of said channel surface 82 extends parallel relative to a dissecting axis 3 extending longitudinally through said impact end portion 5 of said projectile 1.

14. The projectile 1 of any one of embodiments 1 to 13, wherein said projectile further comprises a shank portion 86 opposite said ogive-shaped impact end portion 5, said shank portion 86 having a shank portion diameter $D_{shank}$ that is less than maximum diameter $D_{max}$.

15. The projectile 1 of embodiment 14, wherein said shank portion 86 has a shank portion outer surface 87, and at least a portion of shank portion outer surface 87 extends parallel relative to a dissecting axis 3 extending longitudinally through said impact end portion 5 of said projectile 1.

16. The projectile 1 of embodiment 15, wherein said shank portion 86 further comprises one or more ribs 88 extending outward from said shank portion outer surface 87 and parallel relative to a dissecting axis 3 extending longitudinally through said impact end portion 5 of said projectile 1.

17. The projectile 1 of embodiment 16, wherein each of said one or more ribs 88 has a rib length $L_R$ and a rib width $W_R$ with said rib length $L_R$ being greater than said rib width $W_R$. See, for example, rib length $L_R$ and rib width $W_R$ shown in FIG. 2.

18. The projectile 1 of embodiment 17, wherein said rib length $L_R$ is from about 1.0 millimeters (mm) to about 20.0 mm (or any value between 1.0 mm and 20.0 mm, in increments of 0.1 mm, e.g., 5.2 mm, or any range of values between 1.0 mm and 20.0 mm, in increments of 0.1 mm, e.g., from about 2.6 mm to about 6.8 mm) and said rib width $W_R$ is from about 0.1 mm to about 5.0 mm (or any value between 0.1 mm and 5.0 mm, in increments of 0.1 mm, e.g., 0.5 mm, or any range of values between 0.1 mm and 5.0 mm, in increments of 0.1 mm, e.g., from about 0.4 mm to about 2.4 mm).

19. The projectile 1 of any one of embodiments 16 to 18, wherein said one or more ribs 88 comprises from two to about eight ribs 88 (or any number of ribs 88 between two and eight ribs 88) equally spaced from one another along said shank portion outer surface 87.

20. The projectile 1 of any one of embodiments 16 to 19, wherein said one or more ribs 88 comprises four eight ribs 88 equally spaced from one another along said shank portion outer surface 87.

21. The projectile 1 of any one of embodiments 1 to 20, wherein said projectile further comprises a step portion 89 positioned between said ogive-shaped impact end portion 5 and an opposite end of said projectile 1, said step portion 89 having a step portion diameter $D_{step}$ that is less than maximum diameter $D_{max}$. See, for example, step portion 89 and step portion diameter $D_{step}$ shown in FIG. 2.

22. The projectile 1 of any one of embodiments 14 to 21, wherein said projectile further comprises a step portion 89 positioned between said ogive-shaped impact end portion 5 and said shank portion 86, said step portion 89 having a step portion diameter $D_{step}$ that is less than maximum diameter $D_{max}$ and greater than said shank portion diameter $D_{shank}$.

23. The projectile 1 of embodiment 21 or 22, wherein each of said two or more channels 80 extend into said step portion 89.

24. The projectile 1 of any one of embodiments 14 to 23, wherein said projectile further comprises a transition portion 90 connecting said step portion 89 with said shank portion 86, said step portion 89, said transition portion 90 having a transition portion diameter $D_{TP}$ that decreases as said transition portion 90 moves from said step portion 89 to said shank portion 86. See, for example, transition portion 90 and transition portion diameter $D_{TP}$ shown in FIG. 2. It should be noted that in some embodiments, projectile 1 comprises ogive-shaped impact end portion 5, said step portion 89 and said shank portion 86, without said transition portion 90.

25. The projectile 1 of embodiment 24, wherein said transition portion 90 has a truncated cone shape.

Figure 2:
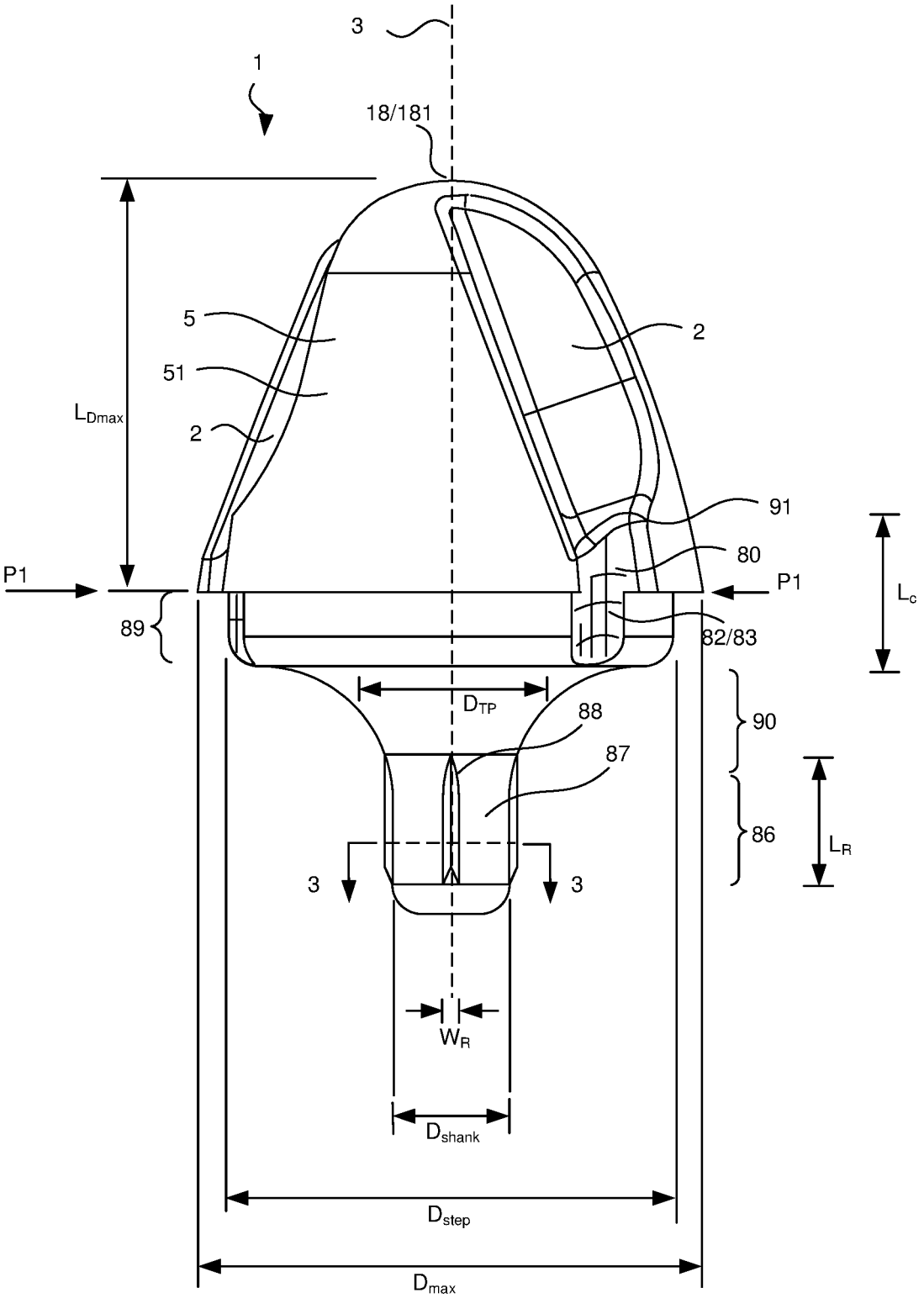
FIG. 2 depicts a frontal view of the exemplary projectile shown in FIG. 1.

26. The projectile 1 of embodiment 24 or 25, wherein said transition portion 90 has a curved truncated cone shape. As used herein, the phrase "curved truncated cone shape" is used to describe the shape of transition portion 90 as shown in FIG. 2.

27. The projectile 1 of any one of embodiments 24 to 26, wherein each of said two or more channels 80 extend to or into said transition portion 90.

28. The projectile 1 of any one of embodiments 24 to 27, wherein each of said two or more channels 80 extend to said transition portion 90.

Figure 1:
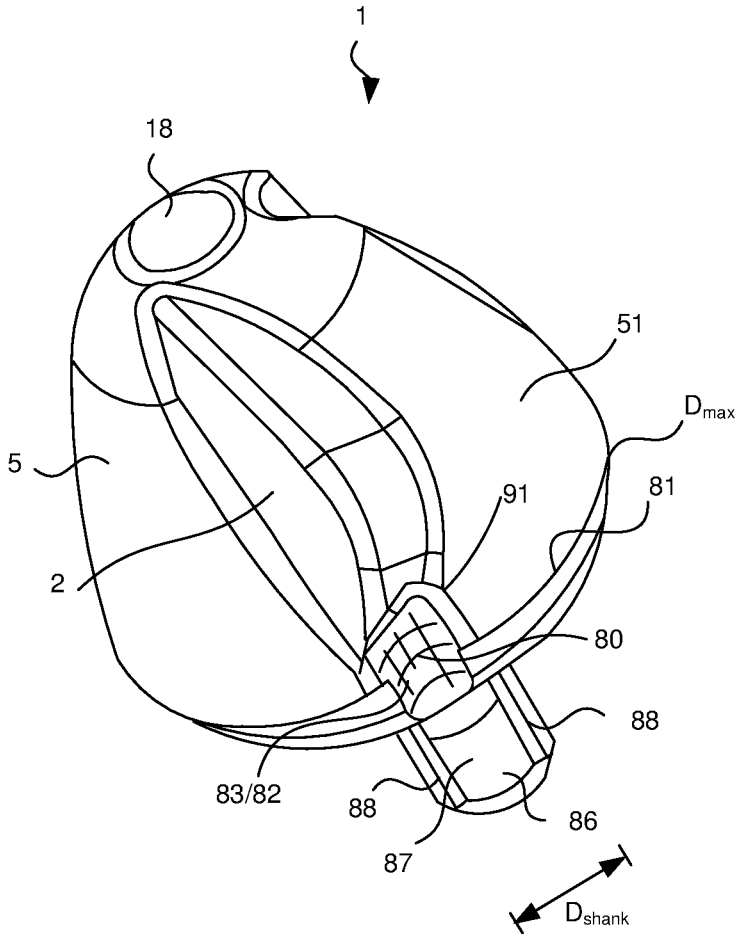
FIG. 1 depicts a perspective view of an exemplary projectile for ammunition of the present invention.

29. The projectile 1 of any one of embodiments 24 to 28, wherein each of said two or more channels 80 extend from a point 91 along said ogive-shaped impact end portion 5 to said transition portion 90. See, for example, point 91 shown in FIGS. 1-2.

30. The projectile 1 of any one of embodiments 1 to 29, wherein each of said two or more channels 80 extend from a point 91 along said ogive-shaped impact end portion 5 to (i) a location along said ogive-shaped impact end portion 5 within which is the plane P1 that contains the maximum diameter $D_{max}$ of said ogive-shaped impact end portion 5, or (ii) a location within a step portion 89 positioned between said ogive-shaped impact end portion 5 and an opposite end of said projectile 1, said step portion 89 having a step portion diameter $D_{step}$ that is less than maximum diameter $D_{max}$, or (iii) a location within a transition portion 90 connecting said step portion 89 with a shank portion 86 of said projectile 1, said transition portion 90 having a transition portion diameter $D_{TP}$ that decreases as said transition portion 90 moves from said step portion 89 to said shank portion 86.

31. The projectile 1 of embodiment 29 or 30, wherein said point 91 is closer to a location along said ogive-shaped impact end portion 5 which is within the plane P1 that contains the maximum diameter $D_{max}$ of said ogive-shaped impact end portion 5 than a projectile tip end 18 of said projectile 1. See, for example, point 91 on exemplary projectile 1 shown in FIGS. 1-2. Typically, if the overall length $LD_{max}$ of projectile 1 from projectile tip end 18 to a location along said ogive-shaped impact end portion 5 which is within the plane P1 that contains the maximum diameter $D_{max}$ of said ogive-shaped impact end portion 5, as measured along a dissecting axis 3 extending longitudinally through said impact end portion 5 of said projectile 1 (see overall length $LD_{max}$ shown in FIG. 2), is X, point 91 is positioned at a location that is less than or equal to about 0.4X from the location along said ogive-shaped impact end portion 5 which is within the plane P1 that contains the maximum diameter $D_{max}$ of said ogive-shaped impact end portion 5 (or any value between 0.01X and 0.4X, in increments of 0.01X, e.g., 0.25X, or any range of values between 0.01X and 0.4X, in increments of 0.01X, e.g., from about 0.22X to about 0.35X).

Figure 11:
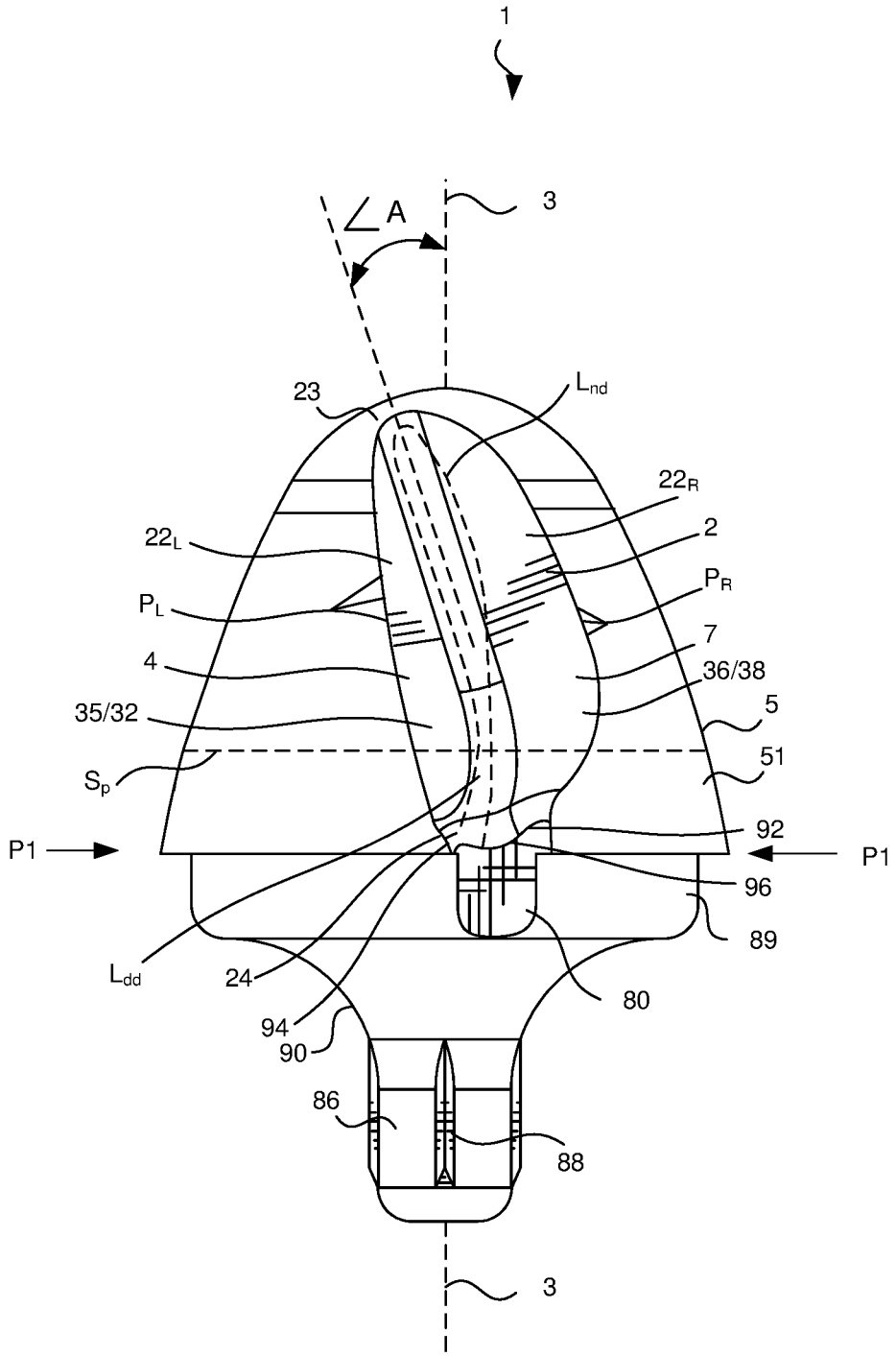
FIG. 11 is a left-hand side view of the projectile for ammunition shown in FIG. 7.
Figure 12:
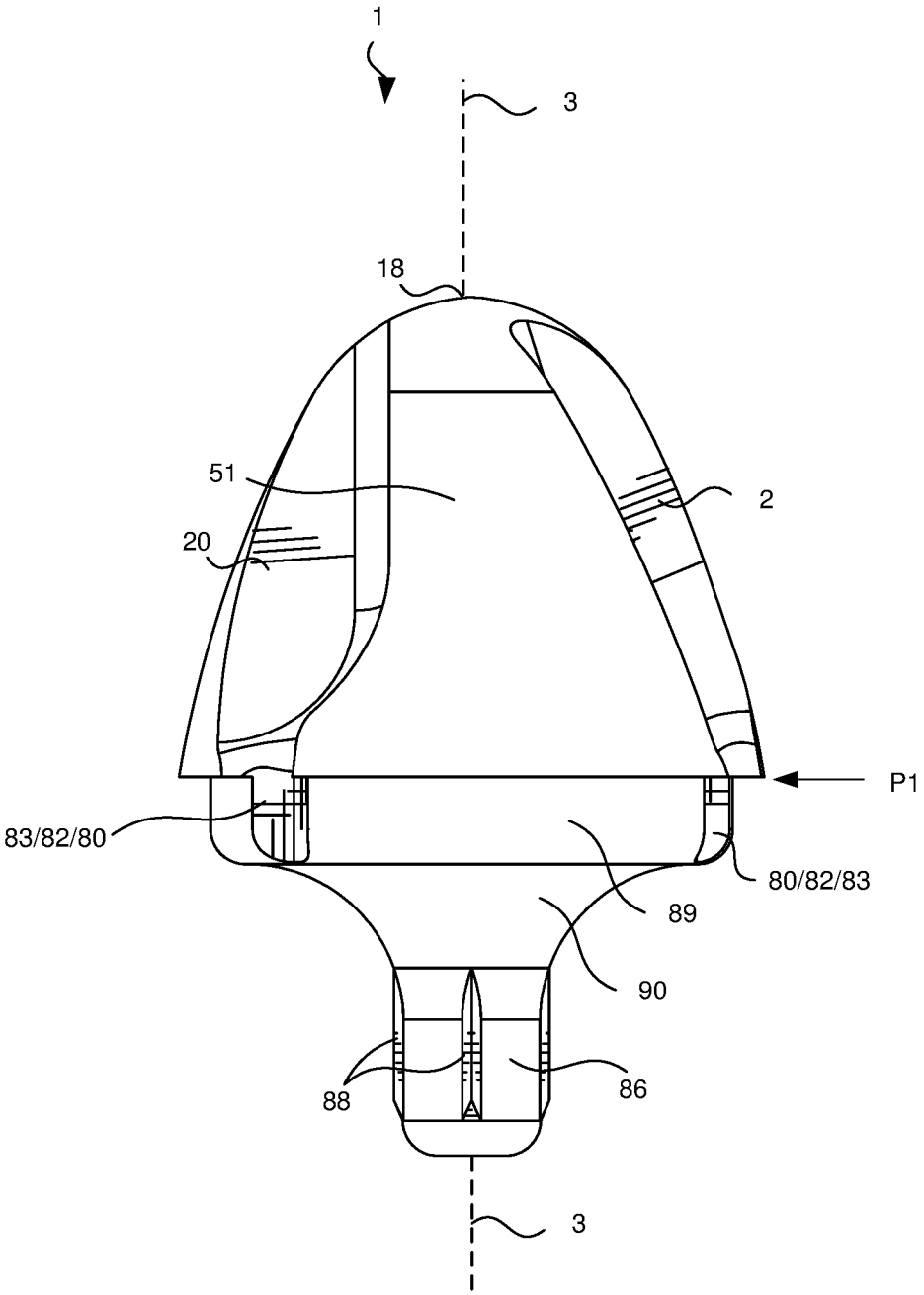
FIG. 12 is a right-hand side view of the projectile for ammunition shown in FIG. 7.
Figure 13A:
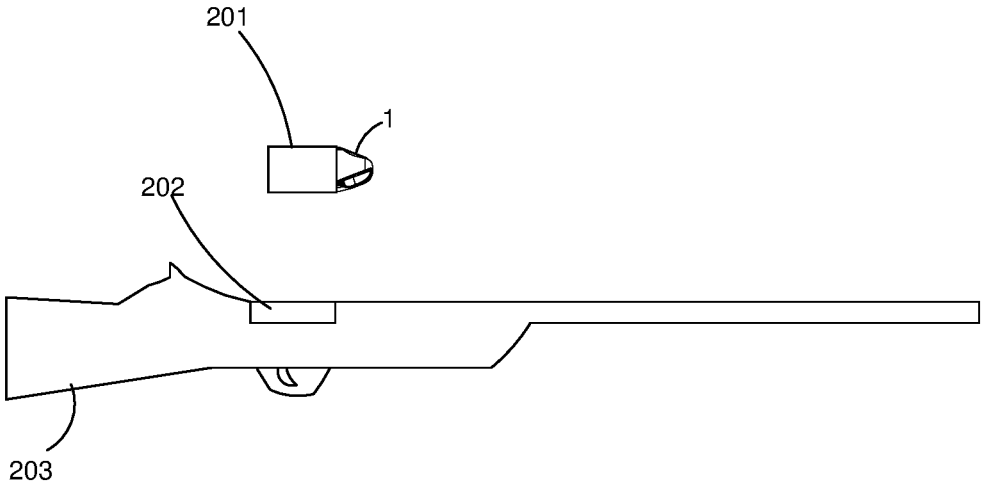
FIGS. 13A-13B depict an exemplary ammunition with casing and projectile (i) prior to firing by an exemplary weapon (FIG. 13A) and (ii) after firing (FIG. 13B).
Figure 13B:
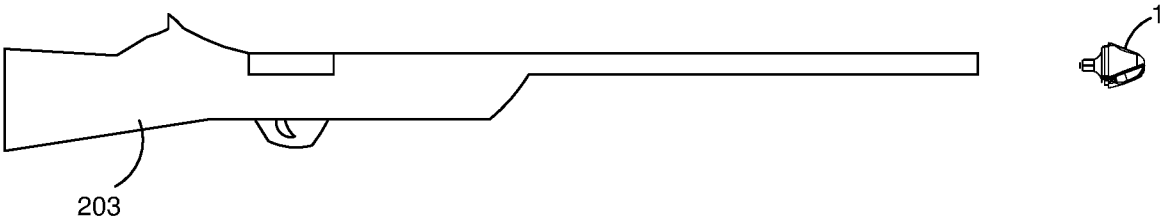

32. The projectile 1 of any one of embodiments 1 to 31, wherein said outer profile geometry further comprises two or more notches 2 extending in at least one of (i) an axial, (ii) parallel or (iii) slightly inclined orientation relative to a dissecting axis 3 extending longitudinally through said impact end portion 5 of said projectile 1, wherein each notch 2 (a) comprises notch surface portions 4,7 so as to increase (i) an overall outer surface area of said ogive end portion 5 of projectile 1, and (ii) a given length of an outer surface periphery $S_p$ extending along a line within a plane normal to said dissecting axis 3, and (b) is at least partially surrounded by an outer surface 51 of said ogive-shaped impact end portion 5 of said projectile 1. In other words, the presence of the two or more notches 2 increases a length of an outer surface periphery $S_p$ extending along a line within a plane normal to said dissecting axis 3 relative to the same outer surface periphery $S_p$ extending within the same plane normal to said dissecting axis 3 when a notch is not present. See, for example, notch 2 features shown in FIG. 11. As shown in the figures, typically, there is one notch 2 for each channel 80 (or vice versa) so as to form two or more combinations of notch 2/channel 80.

33. The projectile 1 of any one of embodiments 1 to 31, wherein said outer profile geometry further comprises two or more notches 2 extending axially along said outer surface profile, wherein each notch 2: (a) comprises notch surface portions 4,7 so as to increase (i) an overall outer surface area of said ogive end portion 5 of projectile 1, and (ii) a given length of an outer surface periphery $S_p$ extending along a line within a plane normal to said dissecting axis 3, (b) is at least partially surrounded by an outer surface 51 of said ogive-shaped impact end portion 5 of said projectile 1; (c) comprises a notch dissecting line $L_{nd}$ extending axially through and being centrally located within said notch 2 (i.e., along a longitudinally length of notch 2), (d) comprises notch outer periphery points $P_L$,$P_R$ along an outer notch perimeter 21 on opposite sides of said notch dissecting line $L_{nd}$, and (e) comprises right and left-hand line portions $\mathbf{22}_L$, $\mathbf{22}_R$ of a normal line extending from said notch dissecting line $L_{nd}$ to each notch outer periphery point $P_L$,$P_R$, wherein each of said right and left-hand line portions $\mathbf{22}_L$, $\mathbf{22}_R$ (i) increases in length along at least a first portion of said notch dissecting line $L_{nd}$ and subsequently (ii) decreases in length along at least a second portion of said notch dissecting line $L_{nd}$ extending between an uppermost periphery portion 23 of said notch 2 and a lowermost periphery portion 24 of said notch 2. See again, for example, notch 2 features shown in FIG. 11.

34. The projectile 1 of any one of embodiments 1 to 31, wherein said outer profile geometry further comprises two or more notches 2 extending axially along said outer surface profile, wherein each notch 2: (a) comprises notch surface portions 4,7 so as to increase (i) an overall outer surface area of said ogive end portion 5 of projectile 1, and (ii) a given length of an outer surface periphery $S_p$ extending along a line within a plane normal to said dissecting axis 3, (b) is at least partially surrounded by an outer surface 51 of said ogive-shaped impact end portion 5 of said projectile 1; (c) comprises a notch depth dissecting line $L_{dd}$ extending axially through and being located along a path that represents a largest depth within said notch 2, (d) comprises notch outer periphery points $P_L$,$P_R$ along an outer notch perimeter 21 on opposite sides of said notch depth dissecting line $L_{dd}$, and (e) comprises right and left-hand line portions $\mathbf{25}_L$,$\mathbf{25}_R$ of a normal line extending from said notch depth dissecting line $L_{dd}$ to each notch outer periphery point $P_L$,$P_R$, wherein each of said right and left-hand line portions $\mathbf{25}_L$,$\mathbf{25}_R$ (i) increases in length along at least a first portion of said notch depth dissecting line $L_{dd}$ and subsequently (ii) decreases in length along at least a second portion of said notch depth dissecting line $L_{dd}$ extending between an uppermost periphery portion 23 of said notch 2 and a lowermost periphery portion 24 of said notch 2. See again, for example, notch 2 features shown in FIG. 11. See also, a description of these notch features as described in U.S. Pat. No. 9,841,260 (e.g., FIGS. 7A-7D and the discussion of these figures in U.S. Pat. No. 9,841,260), the subject matter of which is hereby incorporated by reference in its entirety.

35. The projectile 1 of embodiment 33 or 34, wherein each notch 2 is surrounded by (i) an outer surface 51 and (ii) an upper edge portion 92 of a channel 80 of said ogive-shaped impact end portion 5 of said projectile 1. See, for example, FIG. 11. In addition, as shown in the figures, typically, opposing side edges of a given notch 2 (i.e., opposing side edges within a line extending perpendicular to dissecting line 3 within a given notch 2) are not parallel with one another along outer surface 51. However, opposing side edges of a given channel 80 (i.e., opposing side edges within a line extending perpendicular to dissecting line 3 within a given channel 80) can be and typically are parallel with one another along channel 80.

36. The projectile 1 of any one of embodiments 32 and 34 to 35, wherein each notch 2 comprises: a notch dissecting line $L_{nd}$ extending axially through and being centrally located within said notch 2, (d) comprises notch outer periphery points $P_L$,$P_R$ along an outer notch perimeter 21 on opposite sides of said notch dissecting line $L_{nd}$, and (e) comprises right and left-hand line portions $\mathbf{22}_L$, $\mathbf{22}_R$ of a normal line extending from said notch dissecting line $L_{nd}$ to each notch outer periphery point $P_L$,$P_R$, wherein each of said right and left-hand line portions $\mathbf{22}_L$, $\mathbf{22}_R$ (i) increases in length along at least a first portion of said notch dissecting line $L_{nd}$ and subsequently (ii) decreases in length along at least a second portion of said notch dissecting line $L_{nd}$ extending between an uppermost periphery portion 23 of said notch 2 and a lowermost periphery portion 24 of said notch 2.

37. The projectile of any one of embodiments 32 to 33 and 35 to 36, wherein each notch comprises: a notch depth dissecting line $L_{dd}$ extending axially through and being located along a path that represents a largest depth within said notch 2, (d) comprises notch outer periphery points $P_L$,$P_R$ along an outer notch perimeter 21 on opposite sides of said notch depth dissecting line $L_{dd}$, and (e) comprises right and left-hand line portions $\mathbf{25}_L$,$\mathbf{25}_R$ of a normal line extending from said notch depth dissecting line $L_{dd}$ to each notch outer periphery point $P_L$,$P_R$, wherein each of said right and left-hand line portions $\mathbf{25}_L$,$\mathbf{25}_R$ (i) increases in length along at least a first portion of said notch depth dissecting line $L_{dd}$ and subsequently (ii) decreases in length along at least a second portion of said notch depth dissecting line $L_{dd}$ extending between an uppermost periphery portion 23 of said notch 2 and a lowermost periphery portion 24 of said notch 2.

38. The projectile 1 of any one of embodiments 32 to 37, wherein each notch 2 is parallel relative to one another.

39. The projectile 1 of any one of embodiments 32 to 38, wherein each notch 2 has a slightly inclined orientation relative to said dissecting axis 3. As used herein, the term "slightly inclined" relative to dissecting axis 3 is used to describe an angle A, as shown on FIG. 11, which represents the angle between dissecting axis 3 and a direction of a portion of notch depth dissecting line $L_{dd}$ entering a given notch 2 at uppermost periphery portion 23 of notch 2.

40. The projectile 1 of any one of embodiments 32 to 39, wherein each notch 2 has a slightly inclined orientation relative to said dissecting axis 3, with each notch 2 being oriented at an angle A of greater than zero up to about 45° relative to said dissecting axis 3.

41. The projectile 1 of any one of embodiments 32 to 40, wherein each notch 2 has a slightly inclined orientation relative to said dissecting axis 3, with each notch 2 being oriented at an angle A of from about 15° to about 30° relative to said dissecting axis 3.

42. The projectile 1 of any one of embodiments 33 to 41, wherein said notch dissecting line $L_{nd}$ curves as said notch dissecting line $L_{nd}$ moves from said uppermost periphery portion 23 of said notch 2 to said lowermost periphery portion 24 of said notch 2.

43. The projectile 1 of any one of embodiments 34 to 42, wherein said notch depth dissecting line $L_{dd}$ curves as said notch depth dissecting line $L_{dd}$ moves from said uppermost periphery portion 23 of said notch 2 to said lowermost periphery portion 24 of said notch 2.

44. The projectile 1 of embodiment 43, wherein said notch depth dissecting line $L_{dd}$ has a J-shape or reverse J-shape or a C-shape or a reversed C-shape as said notch depth dissecting line $L_{dd}$ moves from said uppermost periphery portion 23 of said notch 2 to said lowermost periphery portion 24 of said notch 2.

45. The projectile 1 of any one of embodiments 34 to 44, wherein each notch 2 has (i) a first notch surface area 35 and a first depth grade 37 on one side of said notch depth dissecting line $L_{dd}$ (i.e., the left side of $L_{dd}$ shown in FIG. 11) and (ii) a second notch surface area 36 and a second depth grade 38 on an opposite side of said notch depth dissecting line $L_{dd}$ (i.e., the right side of $L_{dd}$ shown in FIG. 11), said first notch surface area 35 being smaller than said second notch surface area 37 and said first depth grade 36 being greater than said second depth grade 38.

46. The projectile 1 of any one of embodiments 32 to 45, wherein said notch surface portions 4,7 comprise one or more cylindrically-shaped or spherically-shaped notch surface portions.

47. The projectile 1 of any one of embodiments 32 to 46, wherein said two or more notches 2 comprise three or more notches 2.

48. The projectile 1 of any one of embodiments 42 to 47, wherein said two or more notches 2 comprise three notches 2 equally spaced from one another.

49. The projectile 1 of any one of embodiments 32 to 47, wherein said two or more notches 2 comprise four notches 2 equally spaced from one another.

50. The projectile 1 of any one of embodiments 32 to 49, wherein each of said two or more notches 2 extends from a projectile tip end 18 or a location proximate said projectile tip end 18 to a location along said ogive-shaped impact end portion 5, but not all the way to a location within which is the plane P1 that contains the maximum diameter $D_{max}$ of said ogive-shaped impact end portion 5. As shown in FIG. 2, point 181 on projectile tip end 18, at which point dissecting axis 3 extends therethrough, is free from any type of notch/indentation (e.g., free of a hollow point indentation). It should be noted that the projectiles of the present invention could have a hollow point indentation at point 181; however, desired projectiles of the present invention do not have a hollow point indentation (or any other indentation/notch) at point 181 as shown in FIG. 2.

51. The projectile 1 of any one of embodiments 32 to 50, wherein each of said two or more notches 2 intersects with a corresponding channel 80 along said ogive-shaped impact end portion 5.

52. The projectile 1 of any one of embodiments 32 to 51, wherein a portion 94 of each of said two or more notches 2 extends below (i.e., is closer to a location which is within the plane P1 that contains the maximum diameter $D_{max}$ of said ogive-shaped impact end portion 5) an upper edge 96 of a corresponding channel 80 along said ogive-shaped impact end portion 5. See, for example, FIG. 11.

53. The projectile 1 of any one of embodiments 32 to 52, wherein each combination of a notch 2 and a corresponding channel 80 (i.e., a connected channel 80) extends from a projectile tip end 18 to (i) a location along said ogive-shaped impact end portion 5 which is within the plane P1 that contains the maximum diameter $D_{max}$ of said ogive-shaped impact end portion 5, or (ii) a location within a step portion 89 positioned between said ogive-shaped impact end portion 5 and an opposite end of said projectile 1, said step portion 89 having a step portion diameter $D_{step}$ that is less than maximum diameter $D_{max}$, or (iii) a location within a transition portion 90 connecting said step portion 89 with a shank portion 86 of said projectile 1, said transition portion 90 having a transition portion diameter $D_{TP}$ that decreases as said transition portion 90 moves from said step portion 89 to said shank portion 86.

54. The projectile 1 of any one of embodiments 14 to 53, wherein said shank portion 86 is integrally connected to said ogive-shaped impact end portion 5. As used herein, the phrase "integrally connected to" refers to two or more components that are formed as a single piece.

55. The projectile 1 of any one of embodiments 21 to 54, wherein said step portion 89 is integrally connected to said ogive-shaped impact end portion 5.

56. The projectile 1 of any one of embodiments 21 to 55, wherein said step portion 89 is integrally connected to said ogive-shaped impact end portion 5 and said shank portion 86.

57. The projectile 1 of any one of embodiments 24 to 56, wherein said transition portion 90 is integrally connected to said step portion 89 and said shank portion 86.

58. The projectile 1 of any one of embodiments 24 to 57, wherein said transition portion 90 is integrally connected to said ogive-shaped impact end portion 5, said step portion 89 and said shank portion 86.

59. The projectile 1 of any one of embodiments 1 to 58, wherein each of (i) said ogive-shaped impact end portion 5, (ii) said step portion 89, (iii) said shank portion 86, and (iv) said transition portion 90 independently comprises a polymeric material, a polymeric matrix material filled with metal particles, a metal, or a combination thereof. For example, any portion of the projectile may comprise a polymeric matrix material (e.g., polyamide) filled with copper or tungsten particles.

60. The projectile 1 of any one of embodiments 1 to 59, wherein each of (i) said ogive-shaped impact end portion 5, (ii) said step portion 89, (iii) said shank portion 86, and (iv) said transition portion 90 independently comprises a polymeric matrix material filled with metal particles.
61. The projectile 1 of any one of embodiments 1 to 59, wherein each of (i) said ogive-shaped impact end portion 5, (ii) said step portion 89, (iii) said shank portion 86, and (iv) said transition portion 90 independently comprises a metal.
62. The projectile 1 of any one of embodiments 1 to 59 and 61, wherein each of (i) said ogive-shaped impact end portion 5, (ii) said step portion 89, (iii) said shank portion 86, and (iv) said transition portion 90 consists of a metal.
63. The projectile 1 of any one of embodiments 59 to 62, wherein said metal is selected from brass, silver, lead, lead alloy, copper plated lead alloy, copper, or stainless steel.
64. The projectile 1 of any one of embodiments 8 to 63, wherein at least a portion of said channel surface 82 extending along length $L_c$ is parallel relative to said dissecting axis 3.
65. The projectile 1 of any one of embodiments 8 to 64, wherein at least a majority of said channel surface 82 extending along length $L_c$ is parallel relative to said dissecting axis 3.
66. The projectile 1 of any one of embodiments 8 to 65, wherein all of said channel surface 82 extending along length $L_c$ is parallel relative to said dissecting axis 3.
67. A projectile 1 for ammunition, said projectile 1 comprising (i) an ogive-shaped impact end portion 5, (ii) a step portion 89 positioned between said ogive-shaped impact end portion 5 and an opposite end of said projectile 1, and (iii) an outer profile geometry on said ogive-shaped impact end portion 5 and said step portion 89, said outer profile geometry comprising two or more channels 80 extending (a) along a portion of an outer periphery 81 of said ogive-shaped impact end portion 5 that is positioned within a plane that contains a maximum diameter $D_{max}$ of said ogive-shaped impact end portion 5 and (b) into said step portion 89.
68. A projectile 1 for ammunition, said projectile 1 comprising (i) an ogive-shaped impact end portion 5 having a maximum diameter $D_{max}$, (ii) a shank portion 86 opposite said ogive-shaped impact end portion 5, said shank portion 86 having a shank portion diameter $D_{shank}$ that is less than said maximum diameter $D_{max}$, and (iii) two or more ribs 88 extending outward from and being equally spaced from one another along a shank portion outer surface 87 of said shank portion 86.
69. The projectile 1 of embodiment 67 or 68, wherein said projectile 1 comprising one or more of the features described in embodiments 1 to 66.
70. A projectile 1 according to any one of embodiments 1 to 69, said projectile 1 being produced by any one of: (i) injection molding a plastic material filled with metal particles, (ii) a sintering step, or (iii) a machining step.
71. A projectile 1 according to any one of embodiments 1 to 70, said projectile 1 being produced by a forming step, said forming step selected from any one or any combination of: (i) a molding step, (ii) a stamping step, (iii) a machining step, (iv) a pressure-applying step, and a striking step.
72. A composite or polymer casing 201 comprising the projectile 1 of any one of embodiments 1 to 71 mounted therein.
73. A metal casing 201 comprising the projectile 1 of any one of embodiments 1 to 71 mounted therein.
74. A plurality of composite or polymer casings 201, metal casings 201, or a combination thereof, wherein each casing 201 within said plurality of casings 201 comprises the projectile 1 of any one of embodiments 1 to 71.
75. A box of composite casings (not shown) comprising: one or more composite or polymer or metal casings 201 comprises the projectile 1 of any one of embodiments 1 to 71; a cartridge-holding device (not shown); and an outer box (not shown) sized to contain said cartridge-holding device with one or more composite casings 201 positioned therein.

Methods of Making Projectiles and Ammunition Embodiments

76. A method of making the projectile 1 for ammunition of any one of embodiments 1 to 71, said method comprising: injection molding a plastic material filled with metal particles, sintering or machining. It should be noted that the step of forming each of (i) ogive-shaped impact end portion 5, (ii) step portion 89, (iii) shank portion 86, and (iv) optional transition portion 90 of projectile 1 may comprise injection molding a plastic material filled with metal particles, sintering or machining.
77. A method of making the projectile 1 for ammunition of any one of embodiments 1 to 71, said method comprising: forming said projectile 1, said forming step selected from any one or any combination of: (i) a molding step, (ii) a stamping step, (iii) a machining step, (iv) a pressure-applying step, and a striking step. It should be noted that the step of forming each of (i) ogive-shaped impact end portion 5, (ii) step portion 89, (iii) shank portion 86, and (iv) optional transition portion 90 of projectile 1 may comprise a forming step selected from any one or any combination of: (i) a molding step, (ii) a stamping step, (iii) a machining step, (iv) a pressure-applying step, and a striking step.
78. The method of embodiment 77, wherein said forming step is a stamping step.
79. The method of embodiment 77, wherein said forming step is a pressure-applying step.
80. The method of embodiment 77, wherein said forming step is a molding step.

Methods of Using Projectiles and Ammunition Embodiments

81. A method of using the projectile 1 for ammunition of any one of embodiments 1 to 71, said method comprising: positioning a composite or polymer or metal casing 201 comprising the projectile 1 in a chamber 202 of a projectile-firing weapon 203; and firing the weapon 203.
82. A method of using the projectile 1 for ammunition of any one of embodiments 1 to 71, said method comprising: positioning the projectile 1 in a chamber 202 of a projectile-firing compressed air weapon (e.g., an air gun) 203; and firing the weapon 203.
83. The method of embodiment 81 or 82, wherein the projectile-firing weapon 203 or projectile-firing compressed air weapon 203 comprises a pistol or any other type of hand gun knot shown).
84. The method of embodiment 81 or 82, wherein the projectile-firing weapon 203 or projectile-firing compressed air weapon 203 comprises a rifle 203 or any other type of long gun (not shown).
85. The method of embodiment 81 or 82, wherein the projectile-firing weapon 203 or projectile-firing compressed air weapon 203 comprises any type of machine or submachine gun knot shown).

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

Preparation of Projectiles and Ammunition

Exemplary projectiles as shown in FIGS. 1-12 were prepared using various projectile-forming steps. In some cases, exemplary projectiles such as shown in FIGS. 1-12 were prepared by injection molding polymer resin, such as a polyamide filled with copper particles, to form 9 mm composite projectiles 1. In other cases, exemplary projectiles such as shown in FIGS. 1-12 were prepared by a stamping process so as to form metal projectiles 1 comprising copper or lead.

The resulting projectiles were incorporated into a metal casing or a composite casing, such as the composite casing disclosed in International Application Ser. No.: PCT/US12/71395, filed on Dec. 12, 2013 and entitled "POLYMER-BASED COMPOSITE CASINGS AND AMMUNITION CONTAINING THE SAME, AND METHODS OF MAKING AND USING THE SAME", the subject matter of which is hereby incorporated herein by reference in its entirety.

The above procedure, or a variation thereof, was used to form projectiles and ammunition containing the projectiles suitable for use in a variety of commercially available rifles, pistols, machine and submachine guns, and air-guns (e.g., pistols and other hand guns, rifles, machine and submachine guns, etc.).

It should be understood that although the above-described projectiles, ammunition and/or methods are described as "comprising" one or more components or steps, the above-described projectiles, ammunition and/or methods may "comprise," "consists of," or "consist essentially of" the above-described components, features or steps of the projectiles, ammunition and/or methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a projectile, ammunition and/or method that "comprises" a list of elements (e.g., components, features, or steps) is not necessarily limited to only those elements (or components or steps), but may include other elements (or components or steps) not expressly listed or inherent to the projectile, ammunition and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a projectile, ammunition and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described projectiles, ammunition and/or methods may comprise, consist essentially of, or consist of any of the herein-described components, features and steps, as shown in the figures with or without any feature(s) not shown in the figures. In other words, in some embodiments, the projectiles, ammunition and/or methods of the present invention do not have any additional features other than those shown in the figures, and such additional features, not shown in the figures, are specifically excluded from the projectiles, ammunition and/or methods. In other embodiments, the projectiles, ammunition and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A projectile for ammunition, said projectile comprising: (I) an outer profile geometry on an ogive-shaped impact end portion thereof, said outer profile geometry comprising two or more channels extending along a portion of an outer periphery of said ogive-shaped impact end portion that is positioned within a plane (P1) that contains a maximum diameter ($D_{max}$) of said ogive-shaped impact end portion, and wherein each of said two or more channels (i) extends a length ($L_a$) that is parallel relative to a dissecting axis extending longitudinally through said impact end portion, and (ii) comprises a channel surface, at least a portion of said channel surface extending along the length ($L_a$) and being parallel relative to said dissecting axis; (II) a shank portion opposite said ogive-shaped impact end portion, said shank portion having (i) a shank portion diameter ($D_{shank}$) that is less than the maximum diameter ($D_{max}$), and (ii) a shank portion outer surface, and at least a portion of said shank portion outer surface extends parallel relative to said dissecting axis; and (III) a step portion positioned between said ogive-shaped impact end portion and said shank portion, said step portion having (i) a step portion diameter ($D_{step}$) that is less than said maximum diameter ($D_{max}$) and greater than said shank portion diameter ($D_{shank}$), and (ii) a step portion outer surface, and at least a portion of said step portion outer surface extending parallel relative to said dissecting axis, wherein each of said two or more channels extend into said step portion.

2. The projectile of claim 1, wherein said two or more channels comprise from three to eight channels.

3. The projectile of claim 1, wherein said two or more channels comprise three or four channels substantially equally spaced from one another.

4. The projectile of claim 1, wherein said channel surface has a geometrically shaped cross-sectional configuration within said channel, said geometrically shaped cross-sectional configuration extending from one lateral side edge of said channel to an opposite lateral side edge of said channel.

5. The projectile of claim 4, wherein geometrically shaped cross-sectional configuration comprises a circular cross-sectional configuration.

6. The projectile of claim 1, further comprising four ribs substantially equally spaced from one another along said shank portion outer surface and extending outwardly along said shank portion outer surface.

7. The projectile of claim 1, wherein said outer profile geometry further comprises a notch for each channel of said two or more channels, each said notch extending in at least one of (i) an axial, (ii) parallel or (iii) slightly inclined orientation relative to said dissecting axis, wherein each said notch (a) comprises notch surface portions so as to increase (i) an overall outer surface area of said ogive end portion, and (ii) a given length of an outer surface periphery ($S_p$) extending along a line within a plane normal to said dissecting axis, and (b) is at least partially surrounded by (i) an outer surface of said ogive-shaped impact end portion, and (ii) an edge of one of said channels of said two or more channels.

8. The projectile of claim 7, wherein each said notch has said slightly inclined orientation relative to said dissecting axis, with each said notch being oriented at an angle (A) of greater than zero up to about 45° relative to said dissecting axis.

9. The projectile of claim 7, wherein (I) a notch dissecting line ($L_{nd}$) of each said notch curves as said notch dissecting line ($L_{nd}$) moves from an uppermost periphery portion of said notch to a lowermost periphery portion of said notch, (II) a notch depth dissecting line ($L_{dd}$) curves as said notch depth dissecting line ($L_{dd}$) moves from said uppermost periphery portion of said notch to said lowermost periphery portion of said notch, and (III) said notch depth dissecting line ($L_{dd}$) has a J-shape or reverse J-shape or a C-shape or a reversed C-shape as said notch depth dissecting line ($L_{dd}$) moves from said uppermost periphery portion of said notch to said lowermost periphery portion of said notch.

10. The projectile of claim 7, wherein each combination of said notch and said corresponding channel extends from a projectile tip end to (i) a location along said ogive-shaped impact end portion which is within the plane (P1) that contains the maximum diameter ($D_{max}$) of said ogive-shaped impact end portion, or (ii) a location within said step portion.

11. A composite or polymer or metal casing comprising: the projectile of claim 1 mounted therein.

12. A method of using the projectile of claim 1, said method comprising:

positioning a composite or polymer or metal casing comprising the projectile in a chamber of a weapon comprising (i) a projectile-firing weapon or (ii) a projectile-firing compressed air weapon; and firing the weapon.

13. The projectile of claim 1, wherein each of said two or more channels extend through said step portion.

14. The projectile of claim 1, further comprising two or more ribs extending outwardly from said shank portion outer surface and being substantially equally spaced from one another along said shank portion outer surface, each of said two or more ribs extending (a) longitudinally along said shank portion outer surface and (b) parallel with said dissecting axis.

15. A projectile for ammunition, said projectile comprising: (i) an ogive-shaped impact end portion having a maximum diameter ($D_{max}$), (ii) a shank portion opposite said ogive-shaped impact end portion, said shank portion having a shank portion diameter ($D_{shank}$) that is less than said maximum diameter ($D_{max}$), (iii) two or more ribs extending outward from a shank portion outer surface and being substantially equally spaced from one another along said shank portion outer surface, each of said two or more ribs extending (a) longitudinally along said shank portion outer surface and (b) parallel with a dissecting axis extending longitudinally through said ogive-shaped impact end portion, (iv) a step portion positioned between said ogive-shaped impact end portion and said shank portion, said step portion having (a) a step portion diameter ($D_{step}$) that is less than said maximum diameter ($D_{max}$) and greater than said shank portion diameter ($D_{shank}$), and (b) a step portion outer surface, and at least a portion of said step portion outer surface extending parallel relative to said dissecting axis, and (v) two or more channels extending along said ogive-shaped impact end portion and within a plane (P1) that contains said maximum diameter ($D_{max}$), and wherein each of said two or more channels (a) extends a length ($L_c$) that is parallel relative to said dissecting axis, and (b) comprises a channel surface, at least a portion of said channel surface extending along the length ($L_c$) and being parallel relative to said dissecting axis; wherein each of said two or more channels extend into said step portion.

16. The projectile of claim 15, further comprising a notch for each channel of said two or more channels, each said notch extending in a slightly inclined orientation relative to said dissecting axis, wherein each said notch (a) comprises notch surface portions so as to increase (i) an overall outer surface area of said ogive end portion, and (ii) a given length of an outer surface periphery ($S_p$) extending along a line within a plane normal to said dissecting axis, and (b) is at least partially surrounded by (i) an outer surface of said ogive-shaped impact end, and (ii) an edge of one of said channels of said two or more channels.

17. A projectile for ammunition, said projectile comprising: (I) an outer profile geometry on an ogive-shaped impact end portion thereof, said outer profile geometry comprising (a) two or more channels extending along a portion of an outer periphery of said ogive-shaped impact end portion that is positioned within a plane (P1) that contains a maximum diameter ($D_{max}$) of said ogive-shaped impact end portion, and wherein each of said two or more channels (i) extends a length ($L_c$) that is parallel relative to a dissecting axis extending longitudinally through said impact end portion, and (ii) comprises a channel surface, at least a portion of said channel surface extending along the length ($L_c$) and being parallel relative to said dissecting axis; and (b) a notch for each channel of said two or more channels, each said notch oriented at an angle (A) of greater than zero up to about 45° relative to said dissecting axis, wherein each said notch (a) comprises notch surface portions so as to increase (i) an overall outer surface area of said ogive end portion, and (ii) a given length of an outer surface periphery ($S_p$) extending along a line within a plane normal to said dissecting axis, and (b) is at least partially surrounded by (i) an outer surface of said ogive-shaped impact end portion of said projectile, and (ii) an edge of one of said channels of said two or more channels (II) a shank portion opposite said ogive-shaped impact end portion, said shank portion having (i) a shank portion diameter ($D_{shank}$) that is less than the maximum diameter ($D_{max}$), and (ii) a shank portion outer surface, and at least a portion of said shank portion outer surface extends parallel relative to said dissecting axis; and (III) a step portion positioned between said ogive-shaped impact end portion and said shank portion, said step portion having (i) a step portion diameter ($D_{step}$) that is less than said maximum diameter ($D_{max}$) and greater than said shank portion diameter ($D_{shank}$), and (ii) a step portion outer surface, and at least a portion of said step portion outer surface extending parallel relative to said dissecting axis, wherein each of said two or more channels extend into said step portion.

* * * * *